US005726634A

United States Patent [19]

Hess et al.

[11] Patent Number: 5,726,634

[45] Date of Patent: Mar. 10, 1998

[54] SMOKE ALARM WITH HIGH AND LOW PITCHED TONES

[76] Inventors: Oneida V. Hess; James L. Hess, both of 5084 Chase Rd., Dearborn, Mich. 48126-3124

[21] Appl. No.: 597,211

[22] Filed: Feb. 6, 1996

[51] Int. Cl.[6] ..... G08B 17/10

[52] U.S. Cl. ..... 340/628; 340/328; 340/384.72; 340/692

[58] Field of Search ..... 340/628–630, 340/328, 384.7, 384.73, 691, 692

[56] References Cited

U.S. PATENT DOCUMENTS 3,860,919 1/1975 Aker ..... 340/384.72
4,303,908 12/1981 Enemark et al. ..... 340/384.72
4,335,379 6/1982 Martin ..... 340/692
5,570,077 10/1996 Swieboda ..... 340/628

*Primary Examiner*—Jeffery Hofsass
*Assistant Examiner*—Daniel J. Wu
*Attorney, Agent, or Firm*—Barnes, Kisselle, Raisch, Choate, Whittemore & Hulbert P.C.

[57] ABSTRACT

A smoke alarm with high and low pitched tones including a conventional smoke detector adapted to activate upon the detection of smoke associated with fire. A first high tone buzzer is included for emitting a high pitched tone upon activation of the smoke detector. A second low tone buzzer is included for emitting a low pitched tone upon the activation of the smoke detector. The first buzzer and second buzzers are adapted to allow the emitted tone thereof to be adjusted thus affording persons with hearing disabilities warning of the presence of fire.

14 Claims, 2 Drawing Sheets

SMOKE ALARM WITH HIGH AND LOW PITCHED TONES

BACKGROUND OF TEE INVENTION

1. Field of the Invention

The present invention relates to a smoke alarm with high and low pitched tones and more particularly pertains to alerting people with hearing disabilities of the presence of a fire.

2. Description of the Prior Art

The use of fire alarms is known in the prior art. More specifically, fire alarms heretofore devised and utilized for the purpose of alerting inhabitants of the presence of a fire are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 5,289,165 to Berlin a smoke alarm which features not only an audible but visual alarm means. U.S. Pat. No. 4,021,792 to Ludt et al. discloses a smoke alarm which features only a smoke alarm mechanism but also a secondary alarm to indicate failure of a light source. U.S. Pat. No. Des. 246,443 to Ernest discloses the ornamental design for a combined fire and smoke alarm as shown and described. Lastly, U.S. Pat. No. 4,104,862 to Yamazaki et al.; U.S. Pat. No. 5,315,292 to Prior; and U.S. Pat. No. Des. 319,600 to Kaiser et al. are provided as being of general interest.

In this respect, the smoke alarm with high and low pitched tones according to the present invention substantially departs from the conventional concepts and designs of the prior art, and in so doing provides an apparatus primarily .developed for the purpose of alerting people with hearing disabilities of the presence of a fire.

Therefore, it can be appreciated that there exists a continuing need for a new and improved smoke alarm with high and low pitched tones which can be used for alerting people with hearing disabilities of the presence of a fire. In this regard, the present invention substantially fulfills this need.

SUMMARY OF THE INVENTION

In view of the foregoing disadvantages inherent in the known types of fire alarms now present in the prior art, the present invention provides an improved smoke alarm with high and low pitched tones. As such, the general purpose of the present invention, which will be described subsequently in greater detail, is to provide a new and improved smoke alarm with high and low pitched tones apparatus and method which has all the advantages of the prior art and none of the disadvantages.

To attain this, the present invention essentially comprises an enclosure with a circular front face and a periphery formed therearound having a plurality of inhalation vents formed therein. A plug is included for connecting to a conventional alternating current receptacle. A conventional smoke detector is connected to the plug. The smoke .detector has a first activated orientation for allowing the transfer of current upon the detection of smoke and a second deactivated orientation for precluding the transfer of current upon the lack thereof. A strobe is connected in series with the smoke detector and is adapted to intermittently actuate upon the receipt of current. A strobe switch is connected in series with the smoke detector and strobe for selectively disengaging the strobe. An adjustable timer controlled relay coil is connected in parallel with the strobe and strobe switch. The timer controlled relay coil is adapted to intermittently shift between an excited state and relaxed state at a predetermined rate upon the receipt of current. Further included is a pair of adjustable buzzers, each with an associated relay contact situated near the relay coil. Each buzzer and associated relay contact are connected in series with the timer controlled relay and further connected in parallel with the strobe and strobe switch. The buzzers are adapted to alternately emit adjustable high and low tones upon the detection of smoke.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved smoke alarm with high and low pitched tones which has all the advantages of the prior art fire alarms and none of the disadvantages.

It is another object of the present invention to provide a new and improved smoke alarm with high and low pitched tones which may be easily and efficiently manufactured and marketed.

It is a further object of the present invention to provide a new and improved smoke alarm with high and low pitched tones which is of a durable and reliable construction.

An even further object of the present invention is to provide a new and improved smoke alarm with high and low pitched tones which is susceptible of a low cost of manufacture with regard to both materials and labor, and which accordingly is then susceptible of low prices of sale to the consuming public, thereby making such fire alarms with high and low pitched tones economically available to the buying public.

Still yet another object of the present invention is to provide a new and improved smoke alarm with high and low pitched tones which provides in the apparatuses and methods of the prior art some of the advantages thereof, while simultaneously overcoming some of the disadvantages normally associated therewith.

Still another object of the present invention is to alert people with hearing disabilities of the presence of a fire.

Lastly, it is an object of the present invention to provide a new and improved smoke alarm with high and low pitched tones including a conventional smoke detector adapted to activate upon the detection of smoke associated with fire. A first high tone buzzer is included for emitting a high pitched tone upon activation of the smoke detector. A second low tone buzzer is included for emitting a low pitched tone upon the activation of the smoke detector. The first buzzer and second buzzers are adapted to allow the emitted tone thereof to be adjusted thus affording persons with hearing disabilities warning of the presence of fire.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
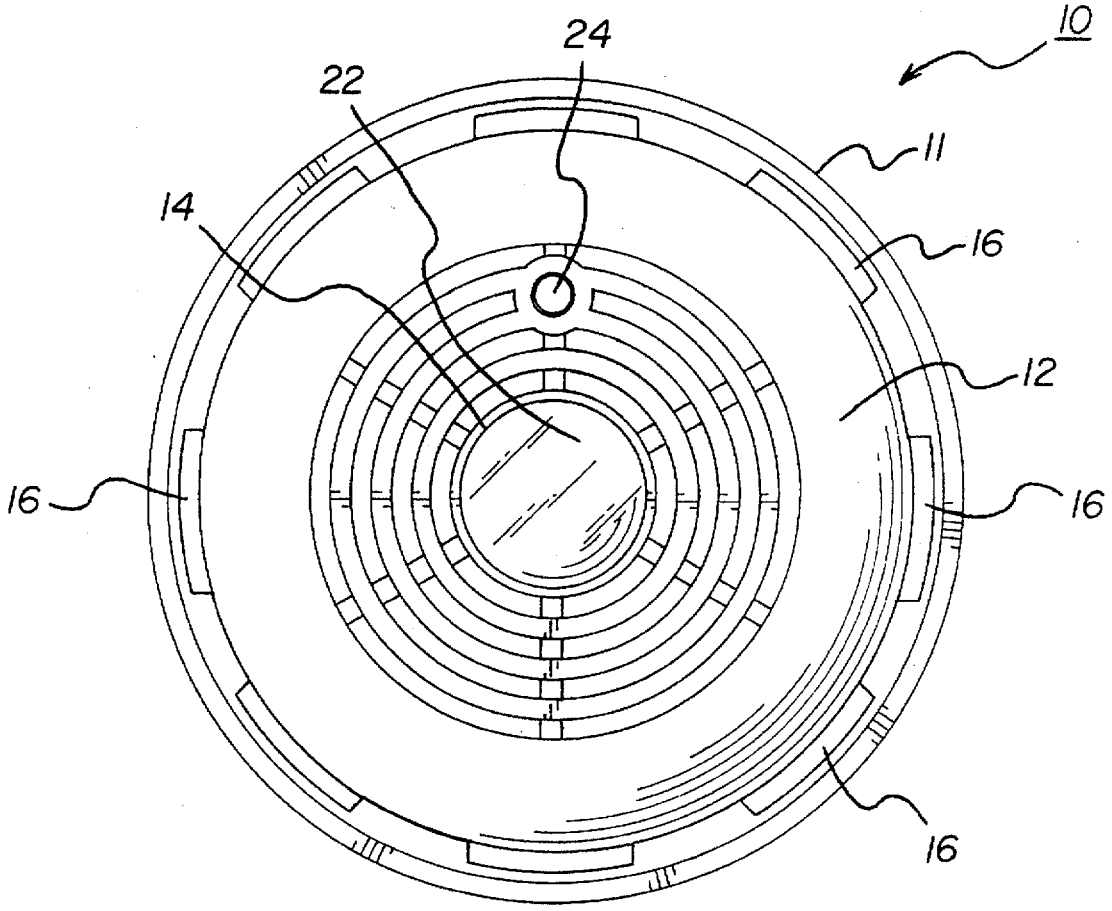
FIG. 1 is a perspective illustration of the preferred embodiment of the smoke alarm with high and low pitched tones constructed in accordance with the principles of the present invention.
Figure 2:
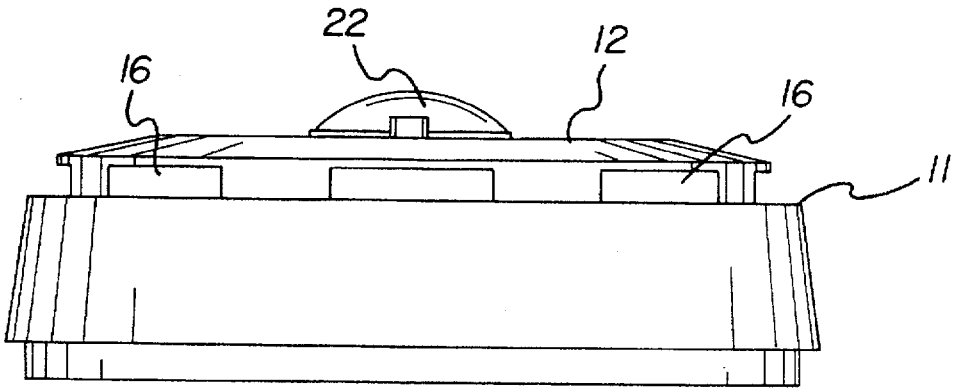
FIG. 2 is a plan side view of the present invention.
Figure 3:
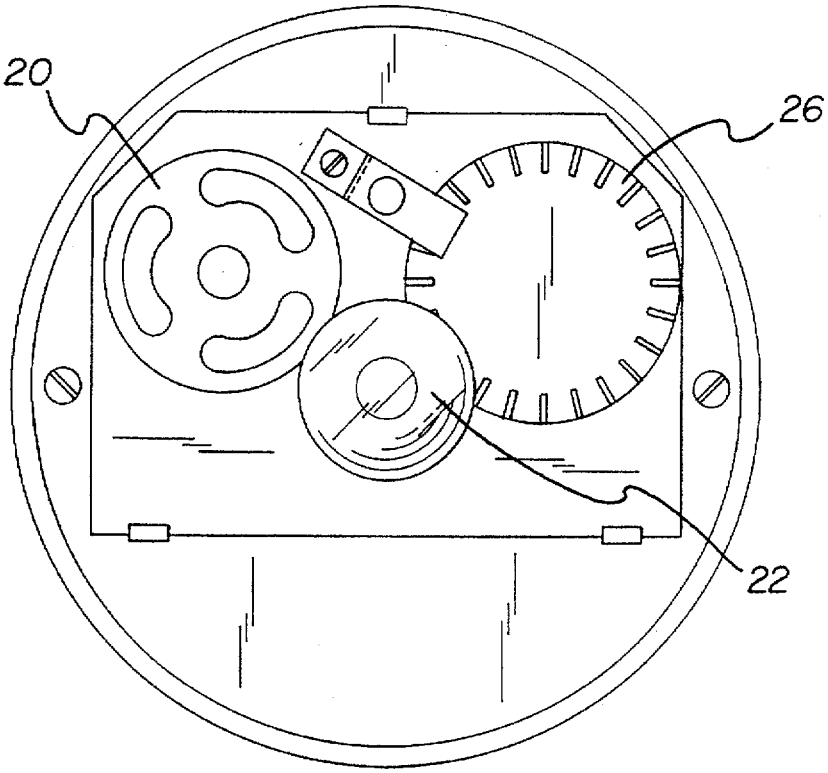
FIG. 3 is a plan rear view of the present invention.
Figure 4:
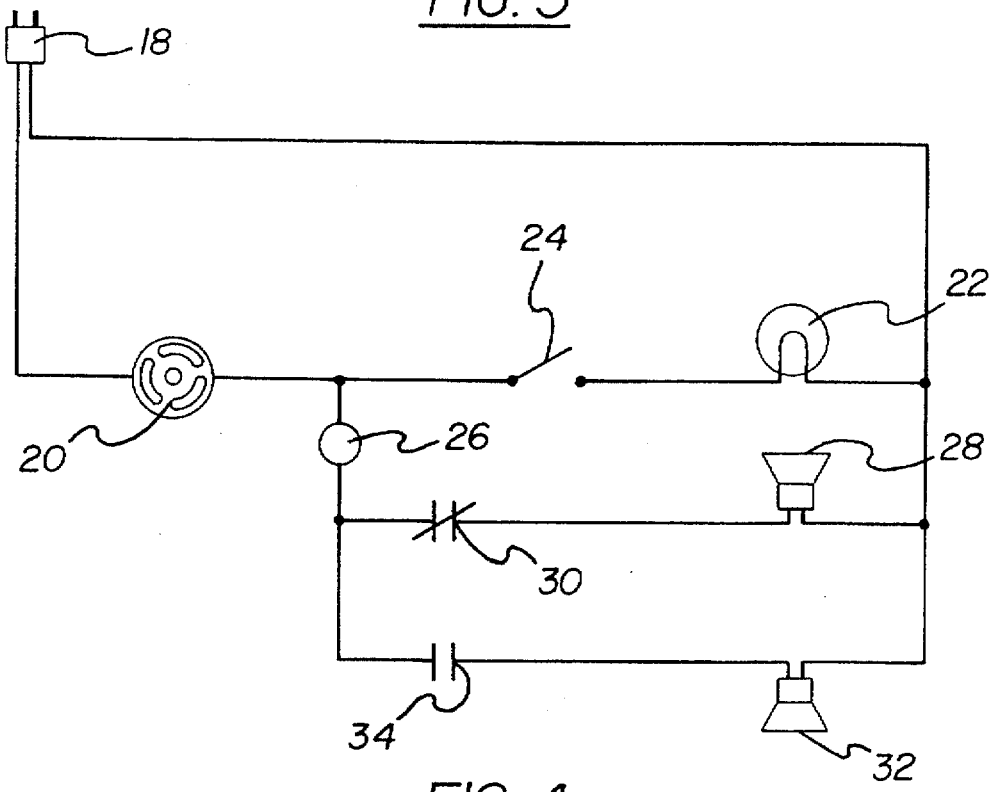
FIG. 4 is a schematic depicting the circuitry employed in the present invention.

With reference now to the drawings, and in particular to FIG. 1 thereof, a new and improved smoke alarm with high and low pitched tones embodying the principles and concepts of the present invention and generally designated by the reference numeral 10 will be described.

The present invention, the new and improved smoke alarm with high and low pitched tones, is comprised of a plurality of components. Such components in their broadest context include an enclosure, smoke detector, timer controlled relay coil, and pair of buzzers with associated relay contacts. Such components are individually configured and correlated with respect to each other so as to attain the desired objective.

More specifically, it will be noted that the system 10 of the present invention includes an enclosure 11 with a circular front face 12 having an aperture 14 formed therein. For inhalation of smoke and audio permeability, a plurality of vents 16 are formed along a periphery of the enclosure. The enclosure is adapted to be secured to a wall or ceiling of a building.

For supplying power to the device, a standard three-prong plug 18 is included for connecting to a conventional alternating current receptacle. Alternatively, a direct current source such as a battery may be employed in lieu of or in combination with the alternating power source.

A conventional smoke detector 20 is connected to the plug. The smoke detector has a first activated orientation for allowing the transfer of current upon the detection of smoke usually associated with fire. The smoke detector further has a second deactivated orientation for precluding the transfer of current upon the lack of detection of smoke.

A strobe 22 is situated within the aperture of the enclosure and is connected in series with the smoke detector. The strobe is adapted to intermittently actuate upon the receipt of current thus providing a visual indication of the presence of smoke. A strobe switch 24 is connected in series between the smoke detector and strobe for selectively disengaging the strobe.

An adjustable timer controlled relay coil 26 is connected in parallel with the strobe and strobe switch and further connected in series with the smoke detector. The timer controlled relay coil is adapted to intermittently shift between an excited state and relaxed state upon the receipt of current. The interim between shifts may be adjusted prior to installation thus determining the rate of shifting. The relay coil remains in the relaxed state upon the lack of current. Such an adjustable timer controlled relay coil is common and commercially available.

A first adjustable high tone buzzer 28 is connected in series with the timer controlled relay coil and further connected in parallel with the strobe and strobe switch. The high tone buzzer is adapted to emit one of a plurality of high pitched tones upon receipt of current. Such an adjustable high tone buzzer is common and commercially available.

Further included is a high tone relay contact 30 associated with the relay coil and connected in series between the high tone buzzer 28 and relay coil 26. The high tone relay contact is also connected in parallel with the strobe and strobe switch. In use, the high tone relay has a first closed orientation for allowing the transmission of current therethrough upon the relaxation of the relay coil and a second open orientation for preventing the transmission thereof upon the excitation of the relay coil.

A second adjustable low tone buzzer 32 is connected in parallel with the high tone buzzer 28 and high tone relay contact 30 and further connected in series with the relay coil 26. The adjustable low tone buzzer 32 is adapted to emit one of a plurality of low pitched tones upon the receipt of current. Such an adjustable low tone buzzer is common and commercially available.

Also included is a low tone relay contact 34 associated with the relay coil 26 and connected in series between the low tone buzzer 32 and relay coil. The low tone relay contact is also connected in parallel with the high tone buzzer 28 and high tone relay contact 30. In use, the low tone relay contact has a first closed orientation for allowing the transmission of current therethrough upon the excitation of the relay coil and a second open orientation for preventing the transmission thereof upon the relaxation of the relay coil.

The present invention provides a smoke alarm that repeatedly emits a high tone warning followed by one that is lower thereby ensuring that people with gaps in their hearing range are able to hear it and evacuate a building to safety. Prior to installation, both the high and low tones are tested on individuals who have a hearing difficulty. Both buzzers may then be adjusted to emit tones whereby all individuals within a living quarters will be clearly and distinctively heard in case of a fire.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved smoke alarm with high and low pitched tones, comprising, in combination:

an enclosure with a circular front face and a periphery formed therearound having a plurality of inhalation vents formed therein and an aperture formed on the front face, the enclosure adapted to be secured to a wall of a building;

a plug for connecting to a conventional alternating current receptacle;

a conventional smoke detector connected to the plug with a first activated orientation for allowing the transfer of current upon the detection of smoke and a second deactivated orientation for precluding the transfer of current upon the lack of detection of smoke;

a strobe situated within the aperture of the enclosure and connected in series with the smoke detector and adapted to intermittently actuate upon the receipt of current;

a strobe switch connected in series with the smoke detector and the strobe for selectively disengaging the strobe;

a adjustable timer controlled relay coil connected in parallel with the strobe and strobe switch, the timer controlled relay coil adapted to intermittently shift between an excited state and a relaxed state at a predetermined rate upon the receipt of current;

a first adjustable high tone buzzer connected in series with the timer controlled relay coil, the high tone buzzer adapted to emit a plurality of high pitched tones upon receipt of current;

a high tone relay contact connected in series between the high tone buzzer and the relay coil, the high tone relay contact having a first closed orientation for allowing the transmission of current therethrough upon the relaxation of the relay coil and a second open orientation for preventing the transmission thereof upon the excitation of the relay coil;

a second adjustable low tone buzzer connected in parallel with the high tone buzzer and high tone relay contact, the adjustable low tone buzzer adapted to emit a plurality of low pitched tones upon the receipt of current; and a low tone relay contact connected in series with the low tone buzzer and further connected in parallel with the high tone buzzer and high tone relay contact, the low tone relay contact having a first closed orientation for allowing the transmission of current therethrough upon the excitation of the relay coil and a second open orientation for preventing the transmission thereof upon the relaxation of the relay coil.

2. A smoke alarm comprising:

a smoke detector having a closed state for allowing the transfer of current and an open state for precluding the transfer of current which changes from one state to the other upon the detection of smoke;

a first buzzer adapted to emit a high pitched tone upon receiving current and constructed to permit adjustment of the frequency of the high pitched tone by the end user;

a second buzzer adapted to emit a lower pitched tone than the first buzzer upon receiving current and constructed to permit adjustment of the frequency of the lower pitched tone by the end user; and a relay downstream of the smoke detector which alternately changes between a de-energized state and an energized state upon receipt of current to alternately supply current to the first buzzer and second buzzer.

3. The smoke alarm of claim 2 wherein when the relay is in its de-energized state current is supplied to one of the first buzzer and the second buzzer and when the relay is in its energized state current is supplied to the other of the first buzzer and the second buzzer.

4. The smoke alarm of claim 3 wherein the relay is adjustable to change the rate at which the relay alternates between its de-energized state and energized state.

5. The smoke alarm of claim 2 wherein the relay also comprises a coil and first contacts having an open state and a closed state and disposed between the relay coil and the first buzzer, and second contacts having an open state and a closed state and disposed between the relay coil and the second buzzer wherein each of the first and second contacts change state upon the receipt of current to permit current to pass through the contacts when closed and prevent current therethrough when opened.

6. The smoke alarm of claim 5 wherein when the first contacts are open the second contacts are closed and when the first contacts are closed the second contacts are open.

7. A smoke alarm comprising:

a smoke detector having a closed state for allowing the transfer of current and an open state for precluding the transfer of current which changes from one state to the other upon the detection of smoke;

a first buzzer adapted to emit a high pitched tone upon receiving current;

a second buzzer adapted to emit a lower pitched tone than the first buzzer upon receiving current and at least one of said first and second buzzers is constructed to permit adjustment by the end user of the frequency of the tone emitted by such buzzer; and a device actuated by the smoke detector which alternately changes state to alternately supply current to the first buzzer and the second buzzer to alternately produce a high pitched tone and a lower pitched tone.

8. The smoke alarm of claim 7 wherein the frequency of the tone emitted by the first buzzer is adjustable by the end user.

9. The smoke alarm of claim 7 wherein the frequency of the tone emitted by the second buzzer is adjustable by the end user.

10. A smoke alarm comprising:

a smoke detector having a closed state for allowing the transfer of current and an open state for precluding the transfer of current which changes from one state to the other upon the detection of smoke;

a first buzzer adapted to emit a high pitched tone upon receiving current;

a second buzzer adapted to emit a lower pitched tone than the first buzzer upon receiving current and at least one of said first and second buzzers is constructed to permit adjustment by the end user of the frequency of the tone emitted by such buzzer; and a relay downstream of the smoke detector which alternately changes between a de-energized state and an energized state upon receipt of current to alternately supply current to the first buzzer and second buzzer.

11. The smoke alarm of claim 10 wherein when the relay is in its de-energized state current is supplied to one of the first buzzer and the second buzzer and when the relay is in its energized state current is supplied to the other of the first buzzer and the second buzzer.

12. The smoke alarm of claim 11 wherein the relay is adjustable to change the rate at which the relay alternates between its de-energized state and energized state.

13. The smoke alarm of claim 10 wherein the relay also comprises a coil, first contacts having an open state and a closed state and disposed between the relay coil and the first buzzer, and second contacts having an open state and a closed state and disposed between the relay coil and the second buzzer wherein each of the first and second contacts change state upon the receipt of current by the coil to permit current to pass through the contacts when closed and prevent current therethrough when opened.

14. The smoke alarm of claim 13 wherein when the first contacts are open the second contacts are closed and when the first contacts are closed the second contacts are open.

* * * * *